United States Patent [19]

Lee

[11] Patent Number: 5,020,349

[45] Date of Patent: Jun. 4, 1991

[54] TUMBLER PIN LOCK SYSTEM

[76] Inventor: Miko Lee, No. 5, Li Hsing Lane, Chung Cheng Rd., Hsing Chuang City, Taipei Hsien, Taiwan

[21] Appl. No.: 609,603

[22] Filed: Nov. 6, 1990

[51] Int. Cl.[5] ..... E05B 27/08

[52] U.S. Cl. ..... 70/491; 70/404; 70/419

[58] Field of Search ..... 70/491, 419, 395, 404

[56] References Cited

U.S. PATENT DOCUMENTS

| | | | |
|---|---|---|---|
| 3,903,720 | 9/1975 | Scherbing | 70/491 |
| 4,083,211 | 4/1978 | Scherbing | 70/491 |
| 4,111,020 | 9/1978 | Scherbing | 70/491 |
| 4,802,354 | 2/1989 | Johnson | 70/491 |
| 4,831,853 | 5/1989 | Lico | 70/491 |
| 4,858,456 | 8/1989 | McGee | 70/491 |

*Primary Examiner*—Robert L. Wolfe

*Attorney, Agent, or Firm*—Bacon & Thomas

[57] ABSTRACT

A tumbler pin lock system comprises a lock mechanism and a key. The lock mechanism has an outer tubular casing mounted to a frame of a computer or similar electrical device. The tubular casing has an central through hole for rotatably receiving a locking spindle. The locking spindle includes a driver pin sleeve having a set of bore holes, each for receiving a driver pin. A rotating shaft protrudes from a first side of the driver pin sleeve, and a protrusion with a keyway slot protrudes from a second side of the driver pin sleeve. A tumbler sleeve is provided on the rotating shaft and is fixed to the tubular casing. The tumbler sleeve has a distributed annular set of blind holes, each for receiving a tumbler spring and a tumbler pin, which are alignable with the bore holes in the driver pin sleeve. A shielding ring having an eccentric flange is received in a key-end of the tubular casing to shield some of the driver pins.

6 Claims, 9 Drawing Sheets

TUMBLER PIN LOCK SYSTEM

BACKGROUND OF THE INVENTION

The present invention relates to a tumbler pin lock system, and more particularly to a tumbler pin lock system for computer, in which some of its drivers ar partially or completely shielded by a shielding ring to prevent an unauthorized person from using the computer.

Applicant's U.S. patent application Ser. No. 07/573,701 discloses a tumbler pin lock system in which some of its drivers are partially or completely shielded by an outer cap to prevent an unauthorized person from using the computer. The tubular casing of the lock system is formed with an eccentric through hole for rotatably receiving a locking spindle.

However, the tumbler sleeve is simply secured to the tubular casing by a pin such that it may be easily loosened and thus cause failure of the lock system. Although a steel pin is mounted into the circumference of the driver pin sleeve, the lock system is still vulnerable to destruction, as the the lock can still be drilled out from a front surface of the key-end of the tubular casing.

The present invention provides a more secure structure for a tumbler pin lock system.

SUMMARY OF THE INVENTION

It is therefore a primary object of the present invention to provide a lock system, wherein some of the driver pins are partially or completely shielded by a shielding ring, having an eccentric hole, in cooperation with a tubular casing, having a central through hole, to prevent an unauthorized person from using the apparatus or device (such as a computer) equipped with the present lock system.

Another object of the present invention is to provide a lock system, in which its shielding ring is freely rotatable within the key-end portion of the tubular casing such that it is not easily destroyed or detached from outside.

It is still another object of the present invention to provide a lock system, wherein a steel ball is anchored in the key-end portion to prevent unauthorized drilling through of the lock.

It is yet another object of the present invention to provide a lock system, wherein a means is provided for securely fixing the tumbler sleeve to the tubular casing.

These and additional objects, if not set forth specifically herein, will be readily apparent to those skilled in the art from the detailed description provided hereunder, with appropriate reference to the accompanying drawings.

BRIEF DESCRIPTION OF THE DRAWINGS

FIGS. 4 through 7 are schematic cross-sectional views showing the operation of the lock system according to the present invention, in which FIG. 4 shows the lock with the key initially inserted;

FIG. 5 shows that the key is moved downward to align the semi-cylindrical slots on the key with the driver pins on the locking spindle;

FIG. 6 shows that the key is moved inward to allow a rotating shaft of the locking spindle to rotate relative to a tumbler sleeve;

FIG. 7 shows that the key is rotated through a predetermined angle to provide a pre-set locking or unlocking function;

DETAILED DESCRIPTION OF THE PREFERRED EMBODIMENTS

Figure 1:
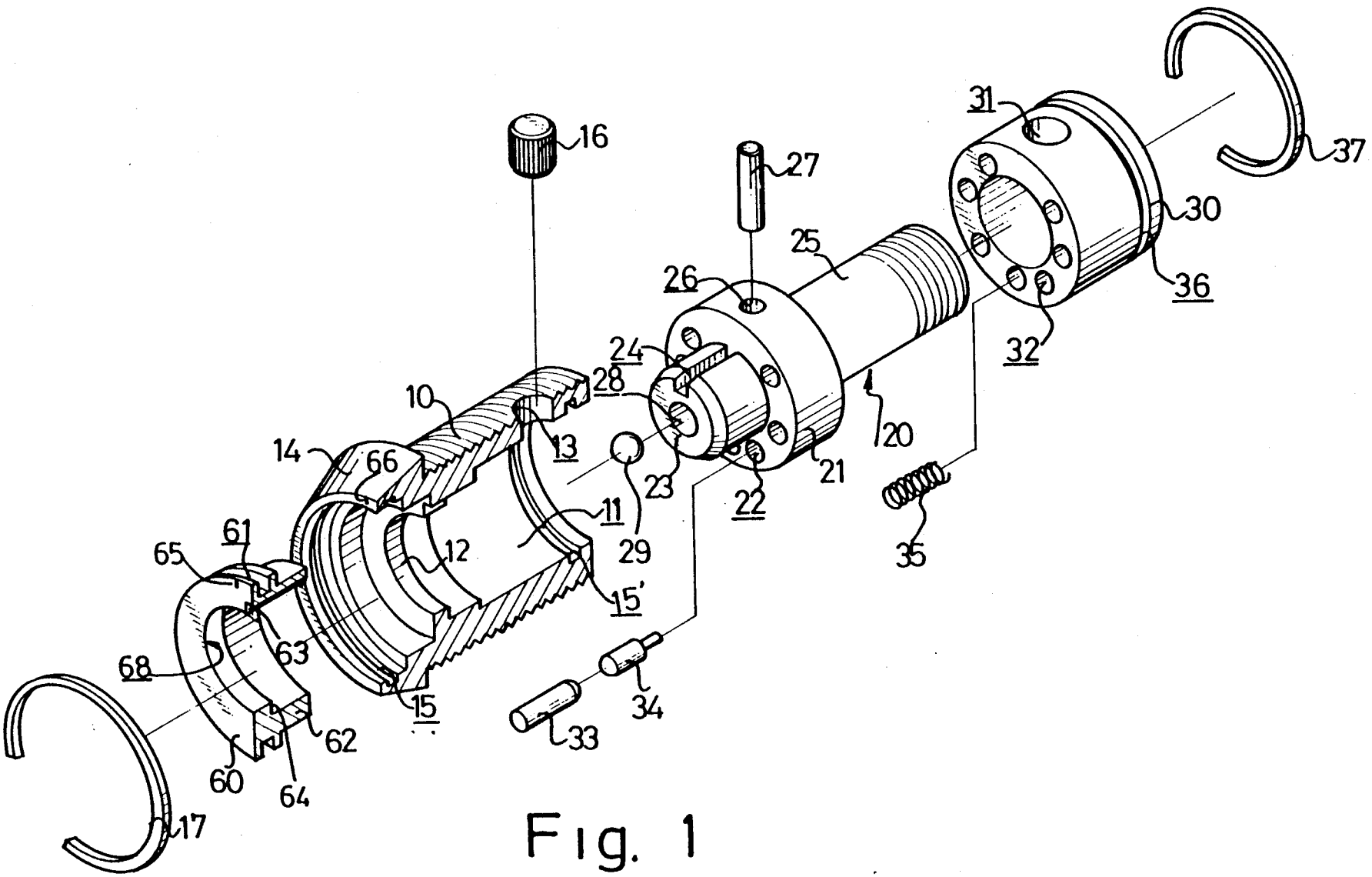
FIG. 1 is an exploded perspective view of a lock of a lock system in accordance with the present invention.

In FIG. 1 is shown a preferred embodiment of an axial pin tumbler lock of the lock system according to the present invention. The lock includes an outer tubular casing 10, a locking spindle 20, a tumbler sleeve 30, and a shielding ring 60. The outer tubular casing 10 has a mounting flange 14 protruding radially from an outer periphery of the tubular casing 10. The mounting flange 14 divides the outer periphery of the tubular casing 10 into a threaded portion and a key-end portion. The key-end portion has an annular groove 15 formed on an inner periphery thereof. The threaded portion is the means by which the lock is secured to a frame (such as a computer panel). The tubular casing 10 has a central through hole 11 for receiving the locking spindle 20. The tubular casing 10 further has an annular retaining ring 12 formed on an inner wall of the key-end portion.

Figure 4:
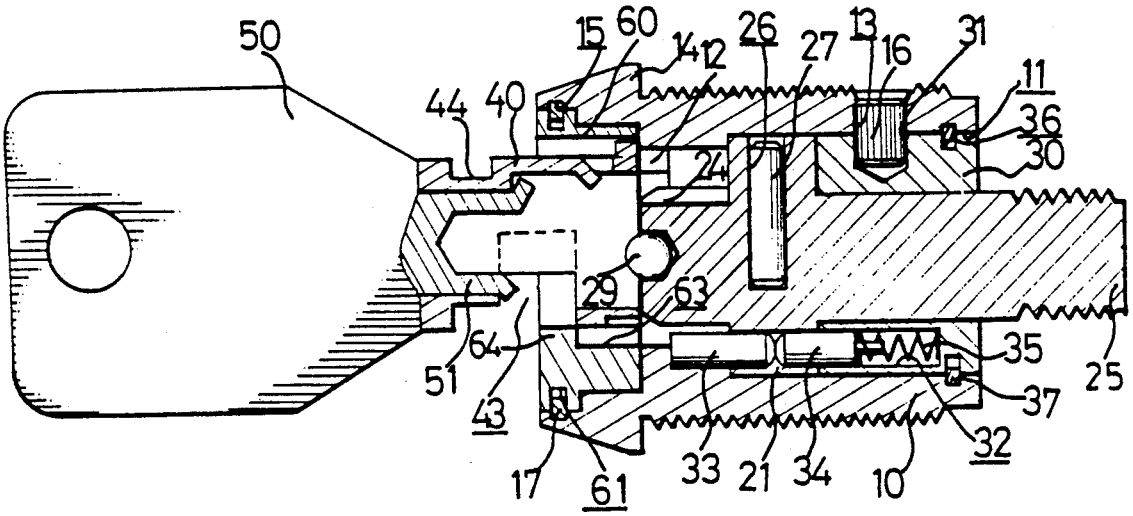

The shielding ring 60 has an outer annular groove 61 which can receive an annular compression ring 17 also fitting into the annular groove 15, in order to rotatably mount the shielding ring 60 in the key-end portion of the tubular casing 10. Referring to FIGS. 1 and 4, the shielding ring 60 has both an eccentric hole 68 on an outer side and a central hole 63 on an inner side relative to the central through hole 11 of the tubular casing 10, thereby forming an eccentric flange 64 for shielding part of the driver pins 33 to be discussed in detail later. Additionally, the shielding ring 60 has an extension 62 so that it may be more stably secured in the key-end portion.

The locking spindle 20 comprises a driver pin sleeve 21 having a set of bore holes 22, each for receiving a driver pin 33 matching and alignable with corresponding blind holes 32 in the tumbler sleeve 30, which will be discussed in detail later. A rotating shaft 25, with a distal threaded portion, protrudes from a first side of the driver pin sleeve 21. The locking spindle 20 further has a protrusion 23 with a keyway slot 24 protruding from a second side thereof. The keyway slot 24 provides a fixed point for the torque arm by means of which the spindle 20 is rotated.

A steel security pin 27 is radially positioned into a pin hole 26 on a circumference of the driver pin sleeve 21, and therein provides security against entry obtained by drilling the lock out. The tumbler sleeve 30, with a distributed annular set of blind holes 32, each for receiving a tumbler spring 35 and a tumbler pin 34, is fixed to the tubular casing 10 at the first side of the driver pin sleeve 21 with an anchoring pin 16 which penetrates through a pin hole 13 in the threaded portion of the tubular casing 10 into an anchoring hole 31 in the tumbler sleeve 30.

A second annular groove 15' is formed on an inner periphery of the central hole 11 adjacent to the anchoring hole 31. Also, an outer annular groove 36 is formed on an outer periphery of the tumber sleeve 30. A second annular compression ring 37, received between the two annular grooves 15' and 36, provides a more secure structure to fixedly retain the tumbler sleeve 30 in the tubular casing 10. Rotation of the locking spindle 20, which constitutes the locking and unlocking action, is so conventional that no further description is required.

Figure 2:
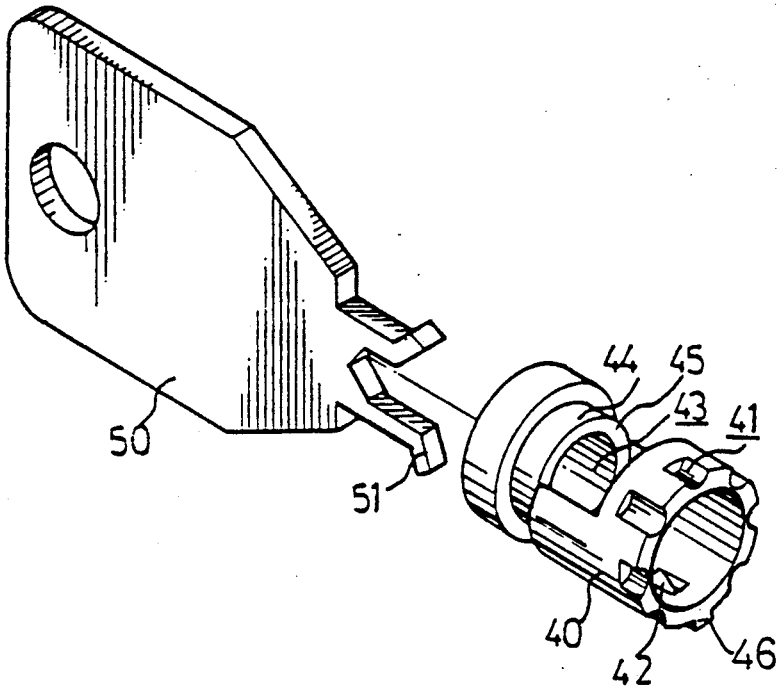
FIG. 2 is an exploded perspective view of a key assembly of a lock system in accordance with the present invention.
Figure 3A:
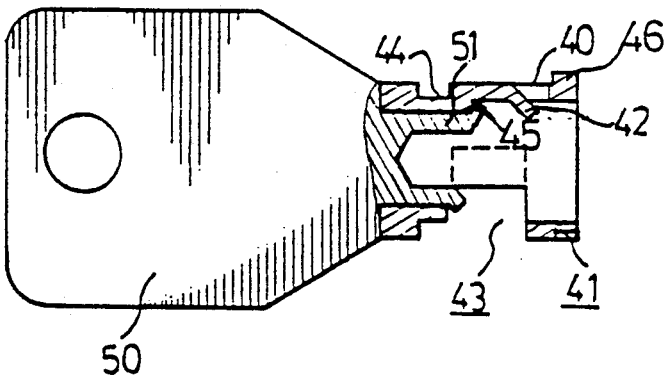
FIG. 3*a* is a side elevational view of an assembled key assembly of the lock system according to the present invention.
Figure 3B:
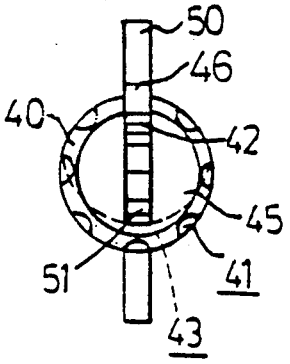
FIG. 3*b* is a right side view of FIG. 3*a*.

Referring to FIGS. 2, 3*a*, and 3*b*, the lock system further includes a key the same as that disclosed in Applicant's U.S. patent application Ser. No. 07/573,701, which comprises a flattened key handle 50 and a cylindrical portion 40. A set of annularly disposed semi-cylindrical slots 41 are formed on an outer periphery of a first end of the cylindrical portion 40, each of a proper depth to engage with corresponding driver pins 33 disposed in the bore holes 22 in the driver sleeve 21. A key guide lug 42 is formed inside the set of the semi-cylindrical slots 41, so as to engage with the keyway slot 24 to turn the rotatable shaft and provide the locking or unlocking function. The structure and function of the semi-cylindrical slots 41 and of the key guide lug 42 are the same as in prior art, except that there is a cutout portion 43 formed in a middle portion of the cylindrical portion 40. In addition, a groove 44 is formed in an outer periphery of a rear portion of the cylindrical portion 40. Like a conventional key, an incorrect key, not providing a proper pattern of slot depths, displaces driver tumblers 33 in such a way that the composite of pin 33, 34 interfaces do not terminate flush with the rotational shear plane between spindle 20 and the tumbler sleeve 30. In an inner wall of the cylindrical portion 40, a retaining flange 45 formed thereon provides a means for attaching an engaging piece 51 of the flattened key handle 50 with the cylindrical portion 40 to form a complete key, as shown in FIGS. 2 and 3*a*. The key also has a conventional indexing flange 46 to properly guide insertion of the key into the lock.

Refer to FIGS. 4 through 7 in which the assembly and operation of the lock system is shown. As can be seen in FIG. 4, the locking spindle 20 is received in the central through hole 11 of the tubular casing 10. The tumbler sleeve 30 is fitted onto the rotating shaft 25 and is adjacent to the first side of the driver pin sleeve 21, and is secured by the anchoring pin 16 and the second annular compression ring 37. Tumbler springs 35, tumblers 34, and driver tumblers 33 are sequentially installed in the blind holes 31 in the tumbler sleeve 30 and in the bore holes 22 of the driver pin sleeve 21. The driver pins 33 are restrained by the retaining ring 12 formed on the inner peripheral wall of the tubular casing 10.

Figure 5:
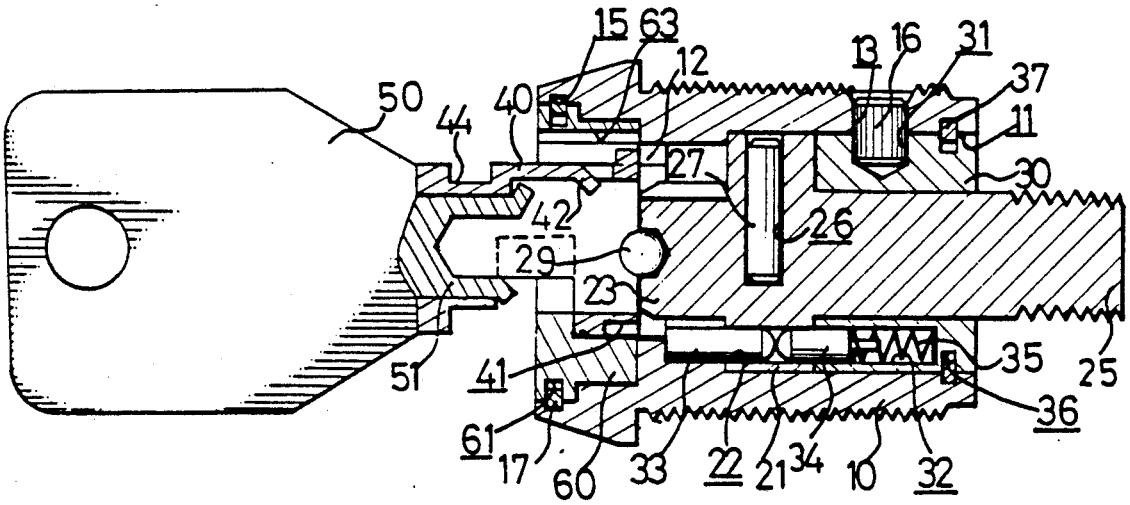
Figure 6:
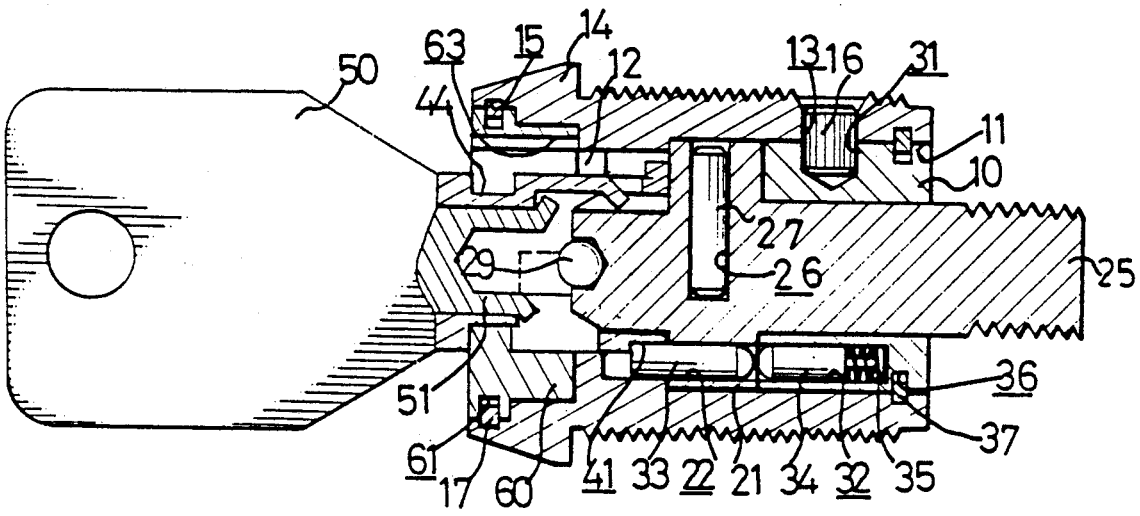
Figure 7:
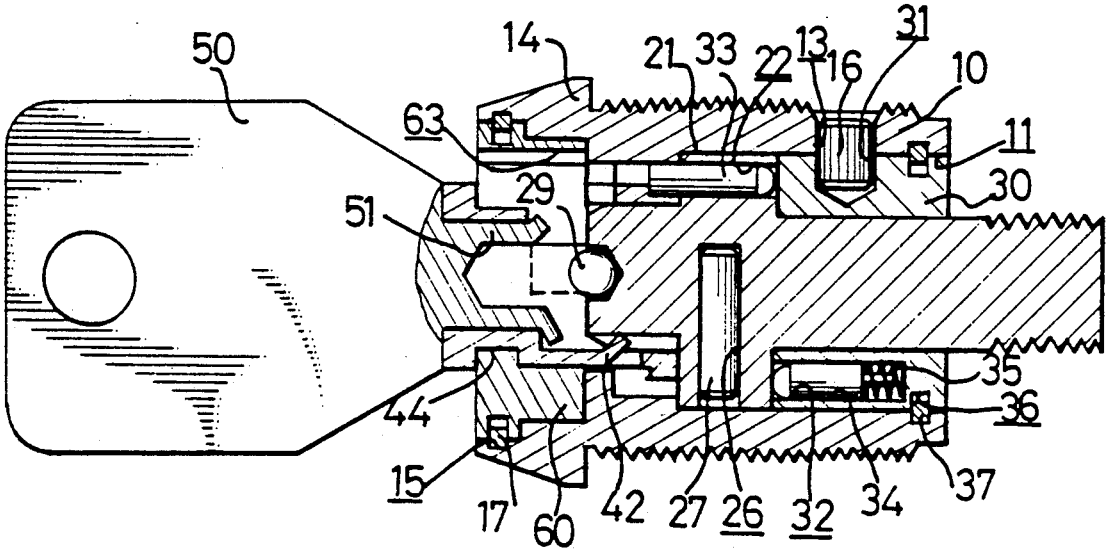

FIG. 4 shows the key initially inserted into the lock assembly. The first end of the cylindrical portion 40 of the key is stopped by the outer edge of the locking spindle 20. The eccentric flange 64 partially and/or completely hides some of the driver pins 33 from outside view. The key is next moved downward such as to align the key guide lug 42 of the key with the keyway slot 24 on the driver pin sleeve 21. At this time, as shown in FIG. 5, the key is in its lowest position, resting on the shielding ring 60. The key can move downward due to the provision of the cutout portion 43.

Next, the key is moved inward, forcing the driver pins 33 and the tumbler pins 34 against the tumbler springs 35. When the key reaches to the position shown in FIG. 6, and the driver pins 33 are completely received in the bore holes 22 and the tumbler pins 34 are completely received in the blind holes 32, the locking spindle 20 becomes rotatable relative to the tumbler sleeve 30. The key can then be rotated through a predetermined angle to turn the computer on or off (see FIG. 7).

As shown in FIG. 1, the shielding ring 60 is rotatably set into the key-end portion of the tubular casing 10. A random rotation of the shielding ring 60 may cause the eccentric flange 64 to be positioned such that the lock system becomes unopenable even with the exact key. Therefore, indicating marks 65 and 66, respectively on the shielding ring 60 and the key-end portion, are required for repositioning the shielding ring 60 to a pre-set operation position. Referring to FIG. 1 and FIGS. 4 through 7, a steel ball 29 is fixedly received in a recess 28 on a front face of the protrusion 23 of the driver pin sleeve 21 to prevent the lock system from being drilled out directly from the front.

Figure 8:
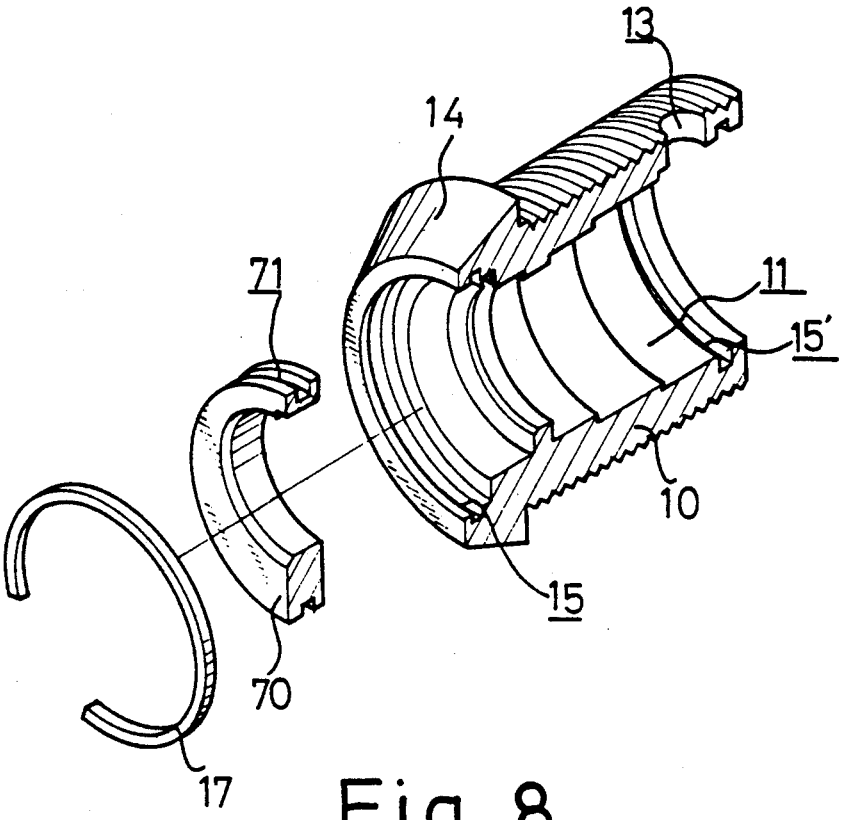
FIG. 8 is a schematic view showing a modification of the shielding ring.

FIG. 8 shows another embodiment of the shielding ring 70 and the key-end portion. As clearly shown in this figure, the shielding ring 70 is substantially an eccentric ring without the central hole 63 and the extension 62 in FIG. 1. The key-end portion is appropriately modified for receiving the shielding ring 70 in order to shield some of the driver pins.

Figure 9:
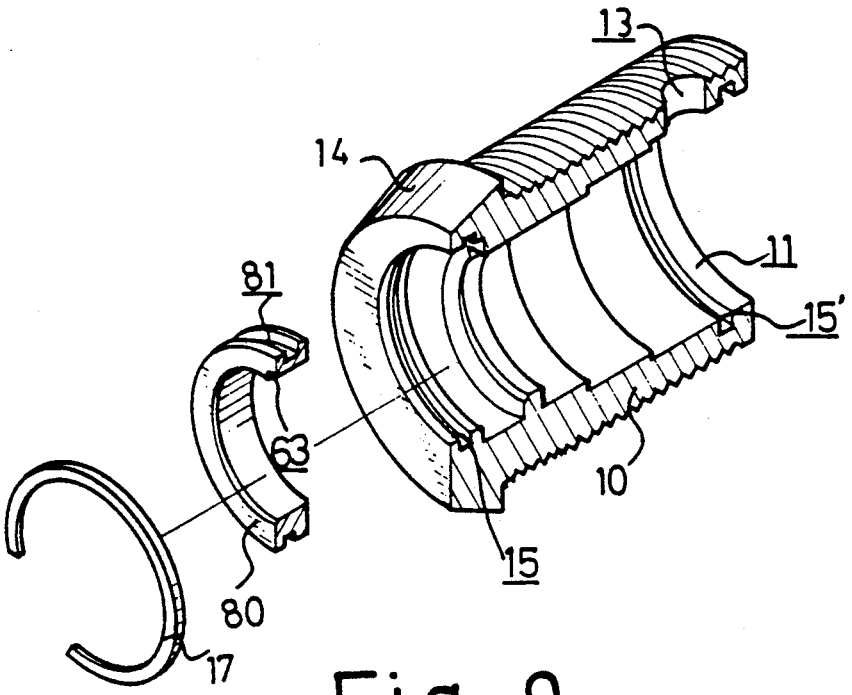
FIG. 9 is a view similar to FIG. 8 showing another modification of the shielding ring and the key-end portion of the tubular casing.

FIG. 9 shows another embodiment of the mounting flange 14 and the shielding ring 80. In this embodiment, the shielding ring 80 is no longer eccentric, and instead the mounting flange 14, especially the key-end portion, is eccentrically formed such as to shield some of the driver pins.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A tumbler pin lock system for computers, comprising a lock mechanism and a key, said lock mechanism comprising an outer tubular casing mounted to a frame of said computer, a mountinng flange protruding radially from an outer periphery of said tubular casing to divide said outer periphery into a key-end portion and a threaded portion, said lock mechanism being secured to said frame by means of said threaded portion, said tubular casing having a central through hole for rotatably receiving a locking spindle, said locking spindle comprising a driver pin sleeve having a set of bore holes each for receiving a driver pin, a rotating shaft protruding from a first side of said driver pin sleeve, a protrusion with a keyway slot protruding from a second side of said driver pin sleeve, a tumbler sleeve being provided on said rotating shaft next to said first side of said driver pin sleeve and being fixed to said tubular casing by an anchoring means, said tumbler sleeve having a distributed annular set of blind holes each for receiving a tumbler spring and a tumbler pin and being alignable with said bore holes in said driver pin sleeve;

said key comprising a flattened key handle and a substantially cylindrical portion, a set of annularly disposed semi-cylindrical slots being formed on an outer periphery of a first end of said cylindrical portion, each of a proper depth to engage with corresponding driver pins disposed in said bore holes in said driver sleeve, a key guide lug being formed inside said set of semi-cylindrical slots to engage with said keyway slot to rotate said rotating shaft relative to said tumbler sleeve to provide a locking or unlocking function, a cutout portion being formed in a middle portion of said cylindrical portion, a groove being formed in an outer periphery of a rear portion of said cylindrical portion, a retaining flange being formed on an inner peripheral wall of said cylindrical portion for attaching an engaging piece of said flattened key handle with said cylindrical portion to form a complete key, the improvements comprising:

a shielding ring being rotatably received in said key-end portion of said tubular casing, said shielding ring having an eccentric through hole defining an eccentric flange such that at least one of said driver pins is shielded.

2. A tumbler pin lock system as claimed in claim 1, wherein a steel ball is fixedly received in a recess on a front face of said protrusion of said driver pin sleeve to prevent the lock system from being drilled out directly from the front.

3. A tumbler pin lock system as claimed in claim 1, wherein an annular groove is formed on an inner periphery of said central through hole of said tubular casing, said tumbler sleeve having a corresponding annular groove formed on an outer periphery thereof, and an annular compression ring being fitted between said two grooves from securing said tumbler sleeve to said tubular casing.

4. A tumbler pin lock system for computers, comprising a lock mechanism and a key, said lock mechanism comprising an outer tubular casing mounted to a frame of said computer, a mounting flange protruding radially from an outer periphery of said tubular casing to divide said outer periphery into a key-end portion and a threaded portion, said lock mechanism being secured to said frame by means of said threaded portion, said tubular casing having a central through hole for rotatably receiving a locking spindle, said locking spindle comprising a driver pin sleeve having a set of bore holes each for receiving a driver pin, a rotating shaft protruding from a first side off said driver pin sleeve, a protrusion with a keyway slot protruding from a second side of said driver pin sleeve, a tumbler sleeve being provided on said rotating shaft next to said first side of said driver pin sleeve and being fixed to said tubular casing by an anchoring means, said tumbler sleeve having a distributed annular set of blind holes each for receiving a tumbler spring and a tumbler pin and being alignable with said bore holes in said driver pin sleeve;

said key comprising a flattened key handle and a substantially cylindrical portion, a set of annularly disposed semi-cylindrical slots being formed on an outer periphery of a first end of said cylindrical portion, each of a proper depth to engage with corresponding driver pins disposed in said bore holes in said driver sleeve, a key guide lug being formed inside said set of semi-cylindrical slots to engage with said keyway slot to rotate said rotating shaft relative to said tumbler sleeve to provide a locking or unlocking function, a cutout portion being formed in a middle portion of said cylindrical portion, a groove being formed in an outer periphery of a rear portion of said cylindrical portion, a retaining flange being formed on an inner peripheral wall of said cylindrical portion for attaching an engaging piece of said flattened key handle with said cylindrical portion to form a complete key, the improvements comprising:

said key-end portion having an eccentric hole defining an eccentric flange such that at least one of said driver pins is shielded; and a shielding ring being rotatably received in said key-end portion.

5. A tumbler pin lock system as claimed in claim 4, wherein a steel ball is fixedly received in a recess on a front face of said protrusion of said driver pin sleeve to prevent the lock system from being drilled out directly from the front.

6. A tumbler pin lock system as claimed in claim 4, wherein an annular groove is formed on an inner periphery of said central through hole of said tubular casing, said tumbler sleeve having a corresponding annular groove formed on an outer periphery thereof, and an annular compression ring being fitted between said two grooves for securing said tumbler sleeve to said tubular casing.

* * * * *